US007667681B2

(12) United States Patent
Murade

(10) Patent No.: US 7,667,681 B2
(45) Date of Patent: Feb. 23, 2010

(54) ELECTRO-OPTICAL DEVICE HAVING EXTERIOR CIRCUIT CONNECTION TERMINAL

(75) Inventor: Masao Murade, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 654 days.

(21) Appl. No.: 10/821,932

(22) Filed: Apr. 12, 2004

(65) Prior Publication Data

US 2004/0246243 A1 Dec. 9, 2004

(30) Foreign Application Priority Data

May 2, 2003 (JP) ..... 2003-127310
Feb. 27, 2004 (JP) ..... 2004-054199

(51) Int. Cl.
*G09G 3/36* (2006.01)

(52) U.S. Cl. ..... 345/92; 349/149

(58) Field of Classification Search ..... 345/94, 345/204, 206; 349/111, 122, 138, 149
See application file for complete search history.

(56) References Cited

U.S. PATENT DOCUMENTS 6,078,367 A * 6/2000 Satou ..... 349/46
6,362,507 B1 3/2002 Ogawa et al.
6,480,244 B2 * 11/2002 Murade et al. ..... 349/43
6,501,096 B1 12/2002 Hashimoto et al.
6,522,319 B1 2/2003 Yamazaki
6,577,371 B2 * 6/2003 Hirabayashi ..... 349/149
6,597,413 B2 * 7/2003 Kurashina ..... 349/39
6,678,017 B1 * 1/2004 Shimomaki et al. ..... 349/40
6,777,973 B2 * 8/2004 Morishita ..... 324/770
6,862,052 B2 * 3/2005 Kim ..... 349/54
2003/0202800 A1 * 10/2003 Matsushima et al. ..... 398/200
2004/0017628 A1 * 1/2004 Murade ..... 359/884
2004/0245551 A1 * 12/2004 Murade ..... 257/222
2006/0102903 A1 * 5/2006 Kim et al. ..... 257/72

FOREIGN PATENT DOCUMENTS

CN 1366652 A 8/2002
JP A-11-72804 3/1999
JP A 11-223832 8/1999
JP A-2001-135640 5/2001
JP A-2001-305580 10/2001
JP A-2002-189228 7/2002
JP A-2002-287149 10/2002
JP A-2003-43508 2/2003
KR 2001-0006164 1/2001
KR 2001-0014785 2/2001

* cited by examiner

*Primary Examiner*—Chanh Nguyen
*Assistant Examiner*—Calvin C Ma
(74) *Attorney, Agent, or Firm*—Oliff & Berridge, PLC

(57) ABSTRACT

An electro-optical device has data lines and scanning lines, TFTs, pixel electrodes, and storage capacitors having capacitor electrodes connected to the TFTs and the pixel electrodes, and the like. In an image display region, a capacitor wire is formed to be connected to or to extend to the capacitor electrodes, and the capacitor wire also extends to exterior circuit connection terminals provided in a peripheral region. By appropriately supplying a predetermined potential to the capacitor electrodes of the storage capacitors, generation of problems, such as a cross-talk on an image or the like, can be suppressed as much as possible, thereby displaying a high quality image.

13 Claims, 10 Drawing Sheets

ELECTRO-OPTICAL DEVICE HAVING EXTERIOR CIRCUIT CONNECTION TERMINAL

BACKGROUND OF THE INVENTION

1. Field of Invention

The present invention relates to the technical field of electro-optical devices, such as an active matrix drive liquid crystal device, an electrophoretic device including electronic paper, and El (electro-luminescence) display devices. The present invention also relates to the technical field of electronic apparatuses provided with the electro-optical device as described above.

2. Description of Related Art

Heretofore, an electro-optical device driven by a so-called active matrix drive system has been known in the related art, in which pixel electrodes arranged in a matrix, thin film transistors (hereinafter "TFT") connected to the respective pixel electrodes, and data lines and scanning lines, which are connected to the respective TFTs and which are disposed in parallel to the row and line directions, respectively, are provided on a substrate.

In the electro-optical device as described above, in addition to those elements mentioned above, a counter substrate facing the aforementioned substrate is provided, and a counter electrode and the like, facing the pixel electrodes are also provided on the counter substrate. Furthermore, a liquid crystal layer held between the pixel electrodes and the counter electrode, storage capacitors connected to the pixel electrodes and to the TFTs, and the like, are provided, thereby performing image display. The orientation of liquid crystal molecules in the liquid crystal layer is appropriately changed in accordance with a predetermined potential difference set between the pixel electrode and the counter electrode. The light transmittance of light passing through the liquid crystal layer is changed in response to the change described above, and hence image display can be performed.

In the case described above, the storage capacitors described above have a function of enhancing the property of retaining a potential of the pixel electrode. For example, in the case in which n scanning lines are sequentially driven, for a period of time between one ON State and the following ON State of a TFT connected to the first scanning line and a corresponding pixel electrode, for example, the potential difference between the pixel electrode and the counter electrode can be retained in a desired state, and as a result, an image having more superior quality can be displayed.

The substrate of the above electro-optical device has an image display region in which scanning lines, data lines, pixel electrodes, storage capacitors, and the like, are provided and a peripheral region in which exterior circuit connection terminals and the like, are provided to supply predetermined signals to the circuits mentioned above.

SUMMARY OF THE INVENTION

However, in related art electro-optical devices which have been used, the following problems have arisen. Although the storage capacitor described above has a dielectric film or the like, sandwiched by a pair of electrodes, one (hereinafter "capacitor electrode") of the pair of electrodes may be retained at a predetermined potential. In order to satisfy the requirement described above, the capacitor electrode is formed to be electrically connected to the exterior circuit connection terminal to which a predetermined potential is supplied from the outside. The electrical connection described above has to be realized between the image display region and the peripheral region described above. In addition, the other electrode of the pair of electrodes must be electrically connected to the pixel electrode and the TFT. This connection is essential to enable the storage capacitor to have a function of enhancing the potential-retaining properties of the pixel electrode. Accordingly, when the storage capacitor is formed on the substrate, several restrictions as described above have to be removed. However, various problems may occur concomitant therewith.

First, in general, in order to form the storage capacitor described above while the trend toward compact, fine, and precise electro-optical devices is being realized, various problems must be overcome. In order to realize the formation of the storage capacitor, it is necessary that while the balance between the storage capacitor and various constituent elements, such as the scanning lines, data lines, and pixel electrodes, formed on a substrate around the storage capacitor, is well taken into consideration, a laminate structure, composed of the constituent elements mentioned above including the storage capacitor, must be formed as suitable as possible.

In addition, in particular, since the storage capacitor described above must be connected to the exterior circuit connection terminal, the following problems have arisen. For example, the following structure has been employed in some cases in which wires extending from the exterior circuit connection terminals and the capacitor electrodes or wires extending therefrom are formed on different layers and in addition are electrically connected to each other via contact holes (the structure described above is one example of the suitable laminate structure to realize the electrical connection described above). However, when the contact hole is used in order to realize the connection described above, a problem of higher resistance caused by the contact hole may arise with high probability. Also, a problem in that properties obtained from contact holes are different from each other may occur in some cases. Hence, the time constant of the capacitor electrode or the wire extending therefrom is increased, and as a result, problems such as cross-talk generated on an image occur. In the case described above, when the wires are formed so as to traverse the image display region, a so-called horizontal cross-talk is to be observed.

The present invention was made in consideration of the problems described above. The present invention provides an electro-optical device which can suppress the occurrences of inconveniences, such as a cross-talk, generated on an image as much as possible by appropriately supplying a predetermined potential to the capacitor electrode of the storage capacitor, and which can display a high quality image. In addition, the present invention provides an electronic apparatus incorporating the electro-optical device described above.

To achieve the above, in accordance with an aspect of the present invention, there is provided an electro-optical device which includes, above a substrate: data lines extending in a predetermined direction and scanning lines extending in a direction intersecting the data lines; switching elements to which scanning signals are supplied from the scanning lines; pixel electrodes to which image signals are supplied from the data lines via the switching elements; an image display region defined as a region of the substrate in which the pixel electrodes and the switching elements are formed; a peripheral region defining the periphery of the image display region; exterior circuit connection terminals provided above the peripheral region along a peripheral side of the substrate; storage capacitors provided above the image display region to retain potentials of the pixel electrodes for a predetermined period of time; and a capacitor wire which supplies a predetermined potential to capacitor electrodes forming the storage capacitors and which is formed as the same film as that for electrodes forming the exterior circuit connection terminals.

According to the electro-optical device of an aspect of the present invention, since a scanning signal is supplied via the scanning line to a thin film transistor, which is one example of the switching element, the ON/OFF state thereof can be controlled. In accordance with the ON/OFF state of the thin film transistor, the supply of an image signal to the pixel electrode via the data line is controlled. Accordingly, the electro-optical device of an aspect of the present invention can be operated in accordance with a so-called active matrix drive system. In an aspect of the present invention, since the storage capacitor is provided to retain a potential of the pixel electrode for a predetermined period of time, the potential-retaining properties of the pixel electrode are enhanced.

In an aspect of the present invention, particularly, the substrate has the image display region and the peripheral region; the pixel electrodes, the switching elements, the storage capacitors, and the capacitor wire are formed in the former region; and the exterior circuit connection terminals are formed in the latter region. As the exterior circuit connection terminal of an aspect of the present invention, for example, there may be mentioned a terminal including an electrode, an insulating film formed thereon, and a contact hole formed in the insulating film to expose the entire or a part of the electrode.

In addition to the structure described above, according to an aspect of the present invention, the capacitor wire is formed as the same film as that for the electrodes forming the exterior circuit connection terminals and supplies a predetermined potential to the capacitor electrodes of the storage capacitors. In an aspect of the present invention, the "formed as the same film as that for" means that, in a manufacturing process of this electro-optical device, solid films for both the electrodes and the capacitor wire are formed at the same time and are then processed by predetermined patterning treatment (including, for example, photolithographic and etching steps) at the same time. Accordingly, the electrodes and the capacitor wire are formed as the same layer of the laminate structure composed of the data lines, scanning lines, pixel electrodes, and the like, and in addition, the electrodes and the capacitor wire are formed of the same material.

According to an aspect of the present invention, since the capacitor wire and the electrodes are formed as the same film in both the image display region and the peripheral region, unlike the case described in "Description of Related Art", it is not necessary that the wire extending from the electrode forming the exterior circuit connection terminal be electrically connected via a contact hole to the capacitor electrode forming the storage capacitor in the image display region or the wire supplying a predetermined potential to the capacitor electrode. Accordingly, the generation of inconveniences of images, such as a horizontal cross-talk, caused by contact holes having irregular properties can be suppressed. In addition, since the electrode and the capacitor wire are formed of the same material, when the material is appropriately selected, the electrode and the capacitor wire can be formed to have lower resistance. As a result, the generation of inconveniences of images can also be suppressed.

In an aspect of the present invention, as the structure in which the capacitor wire serves to supply a predetermined potential to the capacitor electrode, for example, the structure in which the capacitor wire is formed to be connected to or to extend to the capacitor electrode may be used. In this case, the "to be connected to the capacitor electrode" includes, for example, the case in which when being formed on different layers of the laminate structure provided on the substrate, the capacitor electrode and the capacitor wire are electrically connected to each other via a contact hole. In addition, the "to extend to the capacitor electrode" includes, for example, the case in which a pattern having the capacitor wire and the capacitor electrode connected to each other in plan is formed on the same layer of the laminate structure (that is, this pattern includes a portion used for the capacitor wire and a portion used for the capacitor electrode in plan).

In the electro-optical device of an aspect of the present invention described above, the capacitor wire described above may be formed on the data lines with a first interlayer insulating film interposed therebetween.

According to the structure described above, the laminate structure composed of the scanning lines, the data lines, the pixel electrodes, the exterior circuit connection terminals, and the like may be preferably formed on the substrate.

First, since the exterior circuit connection terminals must have electrodes exposed to the outside, they may be formed on a relatively upper layer of the laminate structure described above. Otherwise, a relatively deep contact hole must be formed penetrating from the topmost layer of the laminate structure to the electrode. In addition, according to the structure described above, since the capacitor wire is formed on the data lines, the electrode, which is formed as the same film as that for the capacitor wire and which forms the exterior circuit connection terminal, is also formed on the data lines. Hence, the electrode is also formed on a relatively upper layer of the laminate structure.

According to the structure described above, the laminate structure described above may be formed.

In the electro-optical device of an aspect of the present invention described above, the capacitor wire may be formed in a layer located immediately under a layer including the pixel electrodes.

According to the structure described above, the laminate structure composed of the scanning lines, data lines, pixel electrodes, exterior circuit connection terminals, and the like may be more preferably formed on the substrate. Since the pixel electrodes must face an electro-optical material, when the capacitor wire is formed in the layer which is located immediately under the layer including the pixel electrodes, the case may be typically considered in which the capacitor wire and the pixel electrodes are formed with only one insulating film provided therebetween when viewed from the layer of the electro-optical material. In this case, since the electrodes of the exterior circuit connection terminals formed as the same film as that for the capacitor wire are also formed in the layer which is located immediately under the layer including the pixel electrodes, in general, the insulating film described above is only present on the electrodes described above. The reason for this is that, in the peripheral region, the surface of the insulating film formed immediately under the pixel electrodes is generally exposed to the outside. Hence, according to the structure described above, the exterior circuit connection terminals or the electrodes thereof are extremely easily exposed to the outside.

In the electro-optical device of an aspect of the present invention described above, the capacitor electrodes may be provided below the data lines with a second interlayer insulating film interposed therebetween.

According to the structure described above, since the capacitor electrodes are formed below the data lines, the laminate structure composed of the scanning lines, data lines, pixel electrodes, and the like may be formed on the substrate.

First, since the capacitor electrodes are not formed at least on a layer on which the data lines are formed, as long as other constituent elements are not present, the capacitor electrodes may also be formed in the region right under the data lines. In the case described above, since the capacitor electrode forms a part of the storage capacitor, due to the increase in area of the electrode, the increase in capacitance of the storage capacitor can be easily realized. In addition, since being formed on different layers, the capacitor electrodes and the data lines may be formed of different materials. For example, a material suitable as the electrode of the storage capacitor and a material having higher conductivity may be selected for the former and the latter, respectively, and as a result, the degree of freedom of design can be further enhanced.

In addition to the structure described above, when the aforementioned structure is also used in which the capacitor wire is formed on the data lines, the laminate structure may be realized. In this case, the laminate structure includes the capacitor electrodes, the data lines, and the capacitor wire in that order from the bottom, and by this structure, the effects and advantages described above can be simultaneously realized. In the case described above, electrical connection between the capacitor electrode and the capacitor wire can be realized, for example, by providing a contact hole penetrating the first and the second interlayer insulating films.

The electro-optical device of an aspect of the present invention described above may include a scanning line drive circuit, and a potential supplied to the capacitor wire may include a potential supplied to the scanning line drive circuit.

According to structure described above, since the potential supplied to the capacitor wire includes a potential supplied to the scanning line drive circuit, for example, it is not necessary to prepare electrical power sources for both of them, and hence the structure can be simplified.

In the case described above, the "potential supplied to the scanning line drive circuit" may include a potential at a low potential side supplied to the scanning line drive circuit.

The electro-optical device of an aspect of the present invention described above may include a counter substrate and a counter electrode provided thereon, and a potential supplied to the capacitor wire may include a potential supplied to the counter electrode.

According to the structure described above, since the potential supplied to the capacitor wire includes the potential supplied to the counter electrode, for example, it is not necessary to prepare electrical power sources for both of them, and the structure can be simplified.

In the electro-optical device of an aspect of the present invention described above, the capacitor wire may include a shading material.

According to the structure described above, since the capacitor wire includes a shading material, in the image display region, light shading can be realized in accordance with the region in which the capacitor wire is formed. Hence, light randomly incident on a semiconductor layer (active layer) which forms a thin film transistor, i.e., an example of the switching element, can be blocked. As a result, the generation of light leak current in the semiconductor layer can be suppressed, and the generation of flicker or the like on an image can be reduced or prevented.

Since being formed as the same film as that for the electrodes forming the exterior circuit connection terminals, the capacitor wire can be formed in the peripheral region. According to this structure, the shading properties can also be obtained in the peripheral region. For example, thin film transistors used as the switching elements formed in the peripheral region can also obtain the same effect and advantage as described above. Hence accurate operation of the thin film transistors can be expected.

In the structure described above, besides Al (aluminum) having a relatively large reflectance, the "shading material" includes a pure metal, an alloy, a metal silicide, a polysilicide, or a laminate thereof, containing at least one high melting point metal selected from the group including of Ti (titanium), Cr (chromium), W (tungsten), Ta (tantalum), an Mo (molybdenum).

In the electro-optical device of an aspect of the present invention described above, the capacitor wire may have a multilayer structure formed of different materials.

According to the structure described above, for example, the capacitor wire may be formed to have a two-layered structure composed of an aluminum-based layer as a lower layer and a titanium nitride-based layer as an upper layer. In this case, the shading properties can be obtained since the aluminum-based layer used as the lower layer has a high electrical conductivity and a relatively high reflectance. In addition, due to the presence of the titanium nitride-based layer used as the upper layer, when a solid film of the interlayer insulating film or the like formed on the capacitor wire is processed by patterning, or when a contact hole is formed in the interlayer insulating film, a function of reducing or preventing so-called over-etching can be obtained (that is, the titanium nitride-based layer functions as a so-called etch stopper).

As described above, according to the above structure, since the capacitor wire is formed to have the "laminate structure", in addition to the function of supplying a potential to the capacitor electrodes, a new function can be added. Hence, multifunctionality can be realized.

In addition, as the "laminate structure" described above, it is to be understood that besides the structures described above, various structures may be employed.

In order to achieve the above, an electronic apparatus according to an aspect of the present invention includes the above electro-optical device (including various structures described above) of an aspect of the present invention.

Since being provided with the electro-optical device of an aspect of the present invention, the electronic apparatus of an aspect of the present invention can display a high quality image in which a horizontal cross-talk and the like is not generated at all. Hence, as various electronic apparatus which can be realized, for example, there may be mentioned projectors, liquid crystal televisions, mobile phones, electronic notebooks, word processors, viewfinder type or direct viewing type video tape recorders, work stations, television phones, POS terminals, and touch panels.

The above and other effects and advantages of the present invention will be apparent from the following description of exemplary embodiments and the accompanying drawings.

DETAILED DESCRIPTION OF PREFERRED EMBODIMENTS

Hereinafter, exemplary embodiments of the present invention will be described with reference to the drawings. In the following exemplary embodiment, an electro-optical device of an aspect of the present invention is applied to a liquid crystal device.

Structure of Electro-Optical Device

Figure 1:
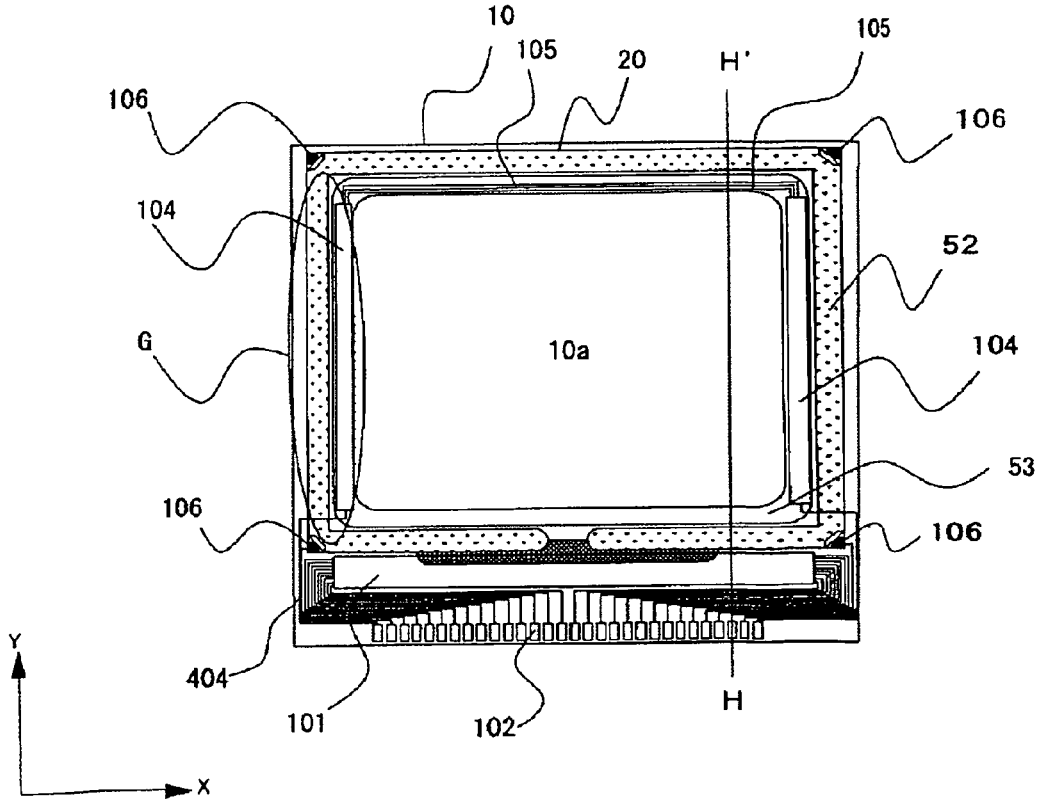
FIG. 1 is a schematic of a TFT array substrate and various constituent elements formed thereon of an electro-optical device, the TFT array substrate being viewed from a counter substrate side.
Figure 2:
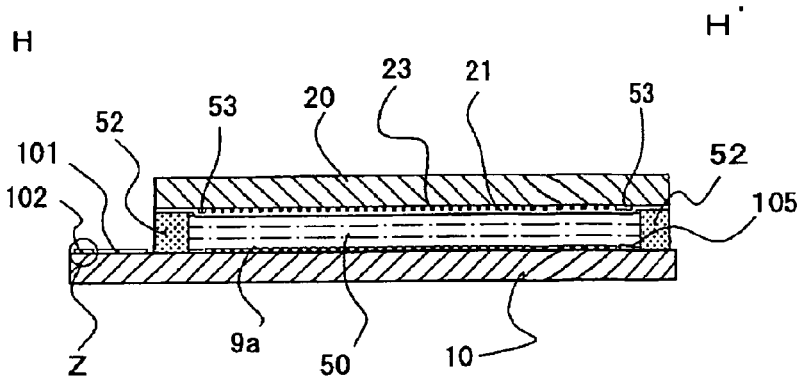
FIG. 2 is a cross-sectional schematic taken along the plane H-H' in FIG. 1.

First, the structure of the electro-optical device of an exemplary embodiment according to an aspect of the present invention will be described with reference to FIGS. 1 and 2. FIG. 1 is a schematic showing a TFT array substrate together with various constituent elements formed thereon of an electro-optical device. The TFT array substrate is viewed from a counter substrate side, and FIG. 2 is a cross-sectional schematic taken along the plane H-H' shown in FIG. 1. In this exemplary embodiment, as an example of an electro-optical device, a TFT active matrix drive liquid crystal device incorporating drive circuits will be described.

In the electro-optical device of this exemplary embodiment shown in FIGS. 1 and 2, a TFT array substrate 10 and a counter substrate 20 are disposed so as to face each other. A liquid crystal layer 50 is sealed between the TFT array substrate 10 and the counter substrate 20. The TFT array substrate 10 and the counter substrate 20 are bonded to each other with a seal material 52 provided in a seal region located along the periphery of an image display region 10*a*.

The seal material 52 is formed, for example, of a UV curable resin or a thermosetting resin to bond the two substrates to each other and is applied onto the TFT array substrate 10 in a manufacturing process, followed by curing by UV radiation, heating, or the like. In addition, in the seal material 52, a gap material, such as glass fibers or glass beads are dispersed so that the distance (gap between the substrates) between the TFT array substrate 10 and the counter substrate 20 is set to a predetermined value. That is, the electro-optical device of this exemplary embodiment has a compact size as a light valve used for a projector and is suitable to perform enlarged display.

In parallel to the inside periphery of the seal region in which the seal material 52 is disposed, a picture-frame shading film 53, having shading properties and defining a picture-frame region of the image display region 10*a*, is provided at the counter substrate 20 side. However, a part or the entire picture-frame shading film 53 described above may be provided as an embedded type shading film at the TFT array substrate 10 side. In this exemplary embodiment, a peripheral region is present which defines the periphery of the image display region 10*a*. In this exemplary embodiment, a region located further from this picture-frame shading film 53 with respect to the center of the TFT array substrate 10 is defined as the peripheral region.

Figure 11:
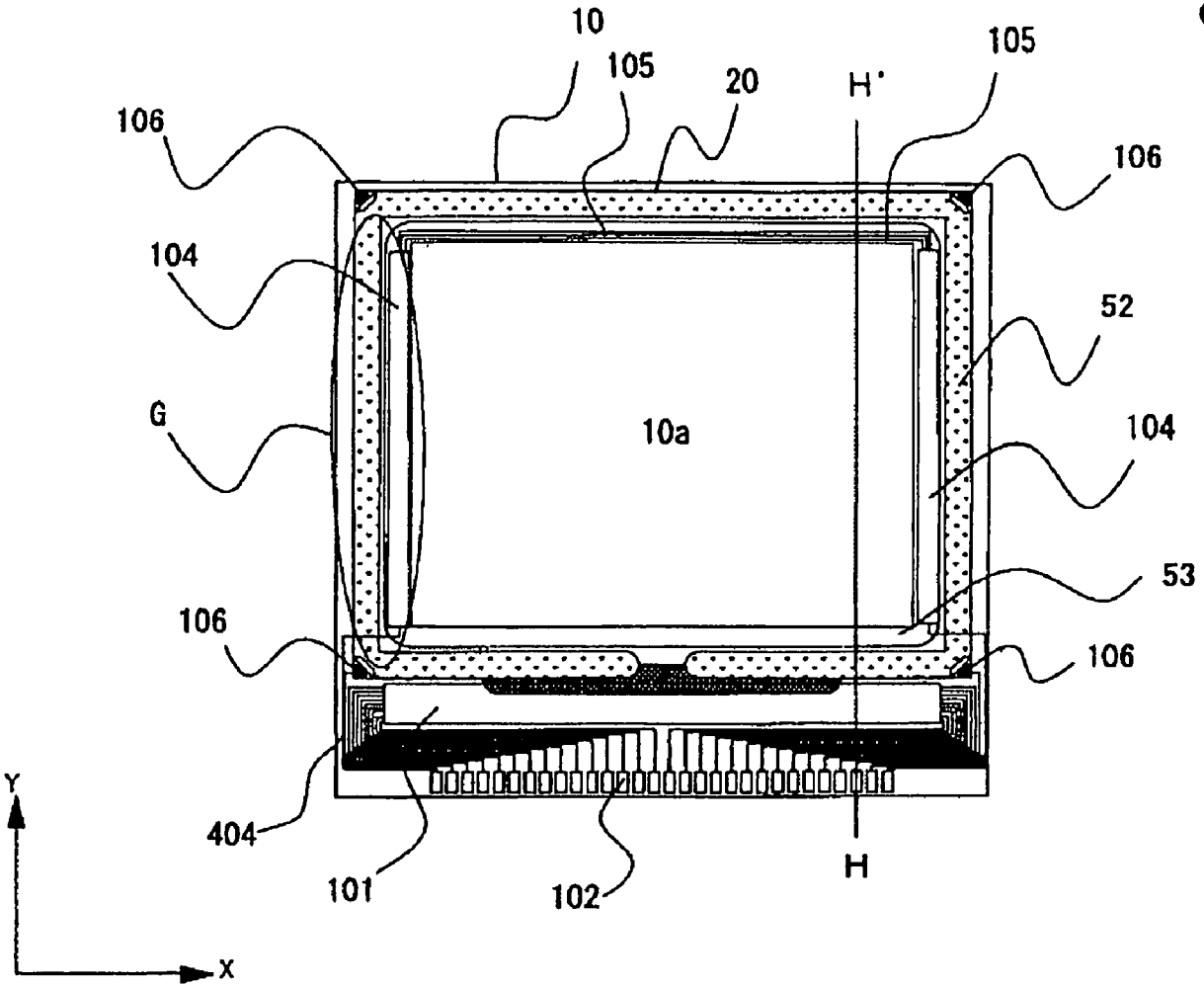
FIG. 11 is a schematic of a TFT array substrate and various constituent elements formed thereon of an electro-optical device according to another exemplary embodiment, the TFT array substrate being viewed from a counter substrate side.

As in another exemplary embodiment shown in FIG. 11, the interior corner portion of the picture-frame shading film 53 may be sharp with no radius instead of a round shape. In addition, the exterior corner portion of the picture-frame shading film 53 may be sharp with no radius instead of a round shape.

In the peripheral region, particularly in a region located outside the seal region in which the seal material 52 is disposed, a date line drive circuit 101 and exterior circuit connection terminals 102 are provided along one side of the TFT array substrate 10. Scanning line drive circuits 104 are provided along two sides adjacent to the one side described above so as to be covered with the picture-frame shading film 53. Furthermore, in order to connect between the two scanning line drive circuits 104 provided on the two sides of the image display region 10*a*, a plurality of wires 105 are provided along the remaining one side of the TFT array substrate 10 so as to be covered with the picture-frame shading film 53. Among those mentioned above, the data line drive circuit 101 and the scanning line drive circuits 104 are connected to the exterior circuit connection terminals 102 via extending capacitor wires 404. In this exemplary embodiment, this extending capacitor wire 404 is characterized by its particular structure and will be described later in detail with reference to FIG. 7 and the like.

In addition, at the four corner portions of the counter substrate 20, vertical conduction members 106 functioning as a vertical conduction terminal between the substrates are disposed. In the TFT array substrate 10, vertical conduction terminals are provided at positions corresponding to the corner portions described above. Hence, the TFT array substrate 10 and the counter substrate 20 can be electrically connected to each other.

In FIG. 2, an alignment film is formed on the pixel electrodes 9*a* located above the TFT array substrate 10 which is provided with pixel switching TFTs and wires, such as scanning lines and data lines. Besides a counter electrode 21, on the counter substrate 20, a shading film 23 having a lattice or a stripe pattern is provided, and an alignment film is also provided as the topmost layer portion. Furthermore, the liquid crystal layer 50 is formed, for example, of at least one type of nematic liquid crystal and is placed in a predetermined orientation state between the pair of the alignment films.

On the TFT array substrate 10 shown in FIGS. 1 and 2, besides the data line drive circuit 101, the scanning line drive circuit 104, and the like, for example, there may be provided a sampling circuit to sample an image signal on an image signal line and supplying it to the data line, a pre-charger circuit to supply a pre-charge signal at a predetermined level to a plurality of data lines before the image signal is supplied thereto, and an inspection circuit to inspect qualities and defects of the electro-optical device in manufacturing or before shipment.

Structure of Pixel Portion

Figure 3:
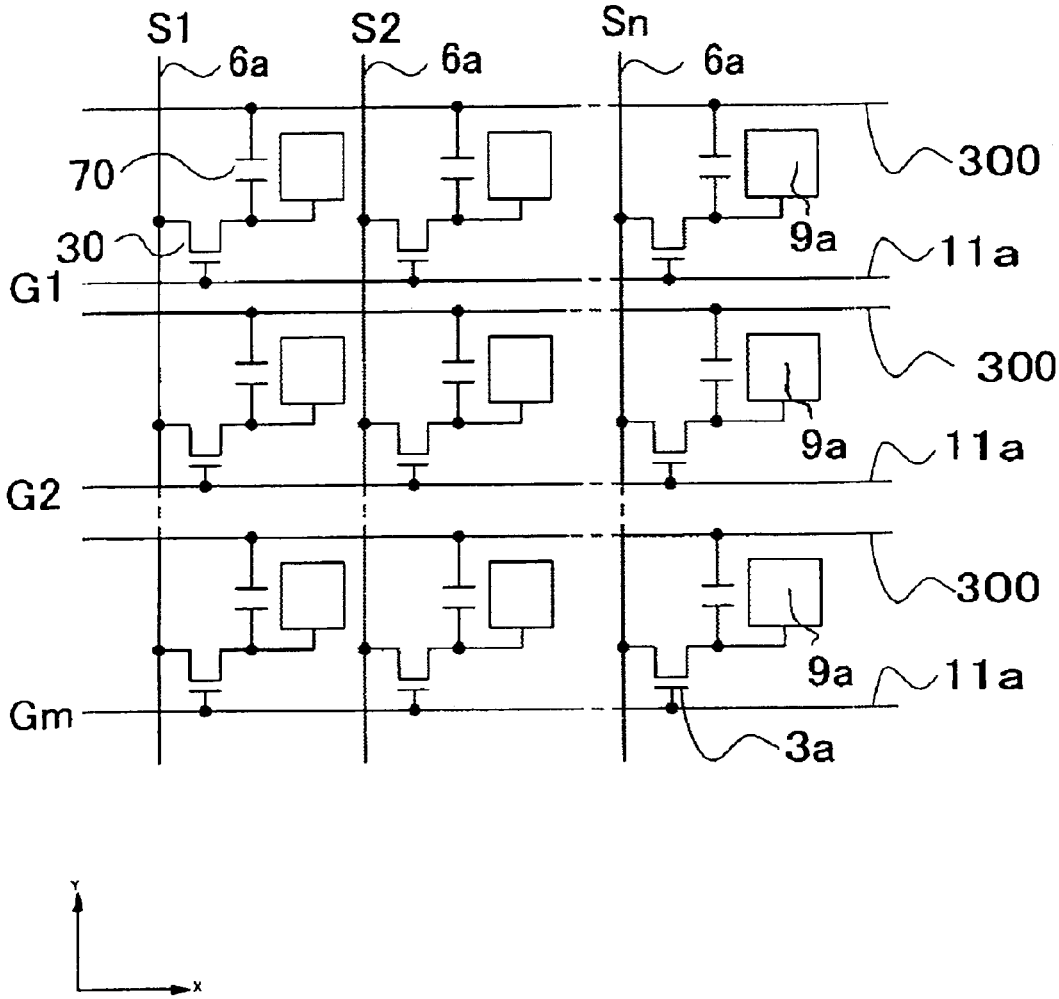
FIG. 3 is an equivalent circuit schematic of various elements, wires, and the like of a plurality of pixels arranged in a matrix which form an image display region of an electro-optical device.
Figure 4:
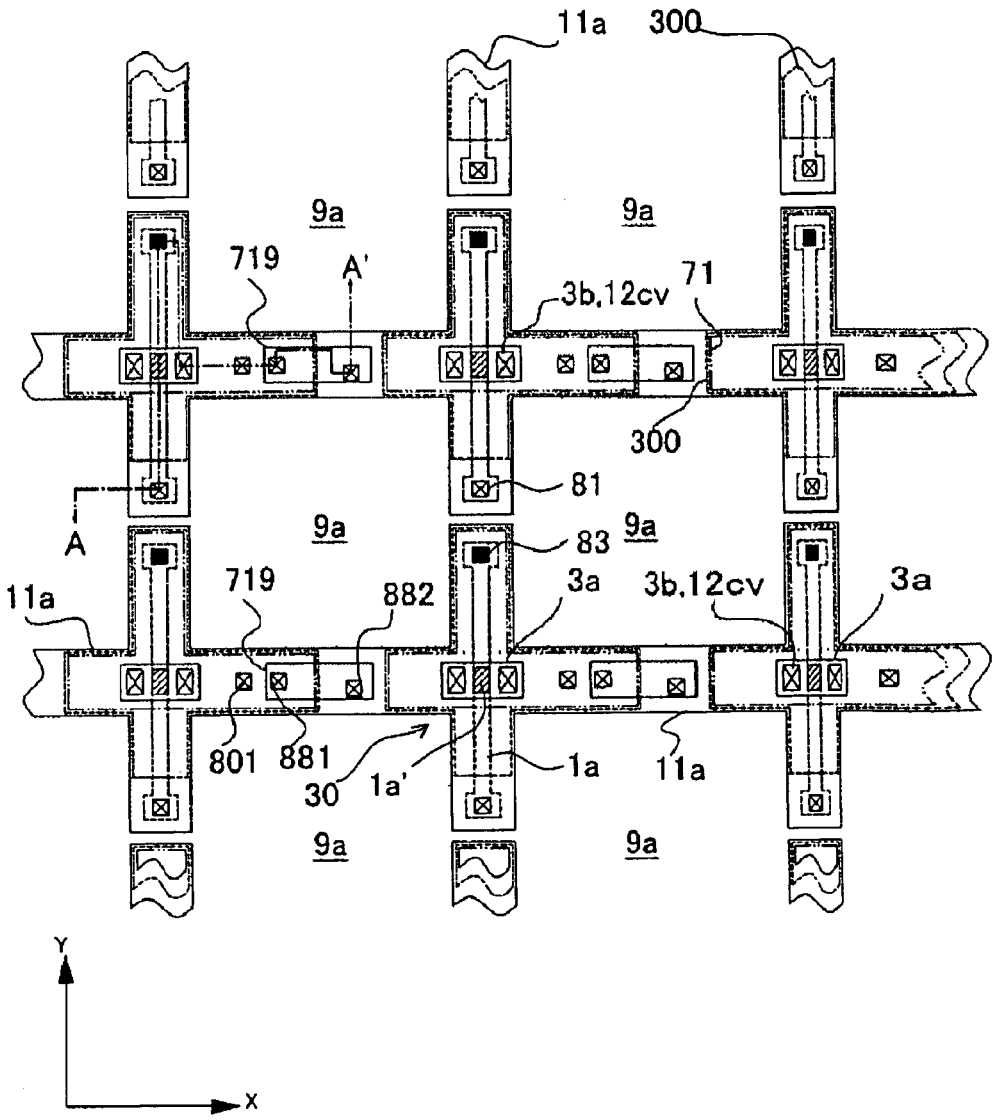
FIG. 4 is a schematic of a plurality of adjacent pixel groups on a TFT array substrate on which data lines, scanning lines, pixel electrodes, and the like are formed, the view only showing the structure of a lower layer portion (the lower layer portion being from the bottom to a layer indicated by reference numeral 70 (storage capacitor) shown in FIG. 6).
Figure 5:
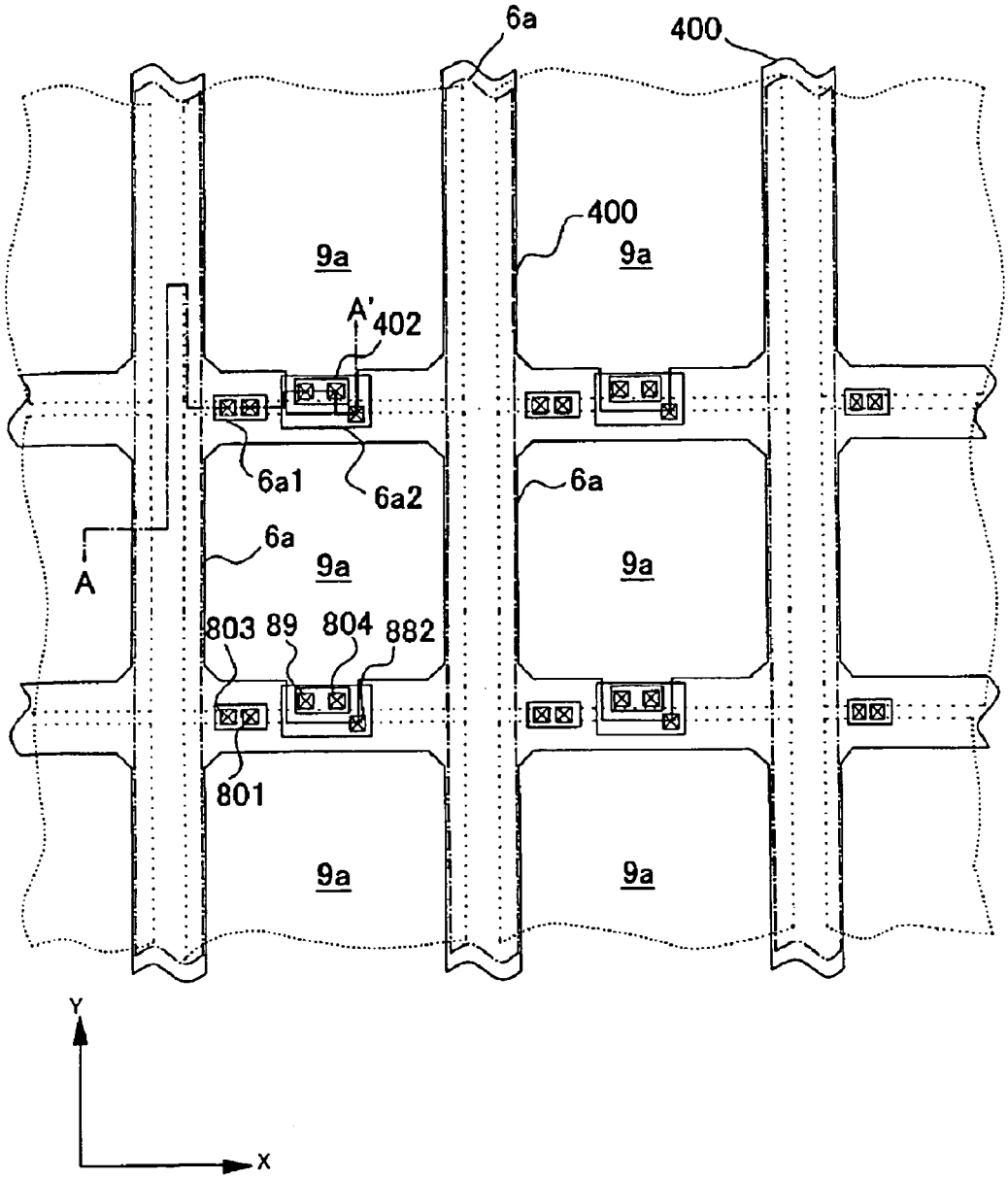
FIG. 5 is a schematic of a plurality of adjacent pixel groups on a TFT array substrate on which data lines, scanning lines, pixel electrodes, and the like are formed, the view only showing the structure of an upper layer portion (the upper layer portion located above the layer indicated by reference numeral 70 (storage capacitor) shown in FIG. 6).

Hereinafter, the structure of a pixel portion of the electro-optical device of this exemplary embodiment of the present invention will be described with reference to FIGS. 3 to 7. FIG. 3 is an equivalent circuit schematic of various elements, wires, and the like provided in a plurality of pixels which are arranged in a matrix and which form an image display region of the electro-optical device, and FIGS. 4 and 5 are schematic of a plurality of adjacent pixel groups formed on the TFT array substrate on which data lines, scanning lines, pixel electrodes, and the like are formed. In addition, FIGS. 4 and 5 show a lower layer portion (FIG. 4) of a laminate structure described below and an upper layer portion (FIG. 5) thereof, respectively.

Figure 6:
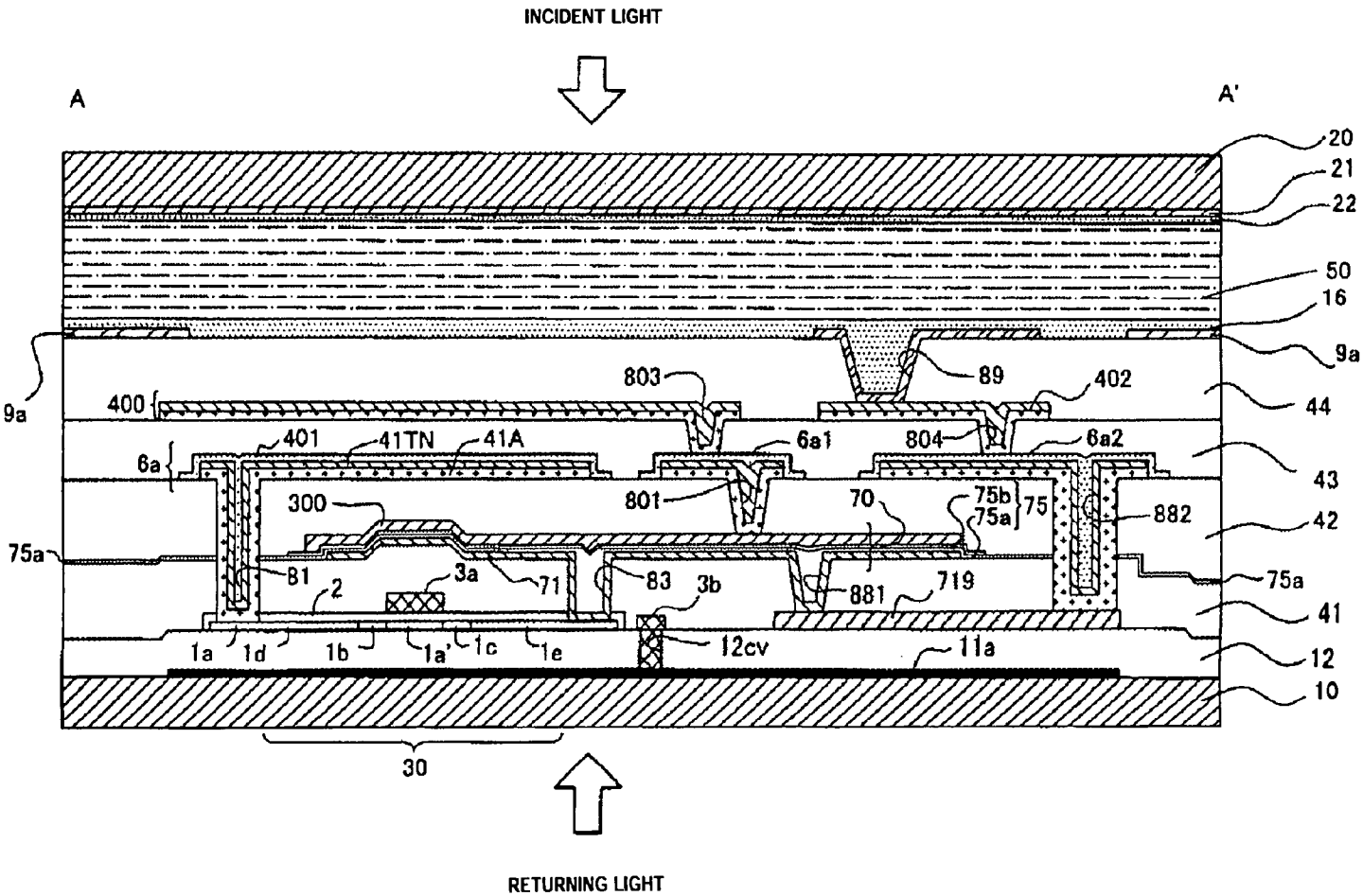
FIG. 6 is a cross-sectional schematic taken along the plane A-A' when views shown in FIGS. 4 and 5 are overlapped with each other.
Figure 7:
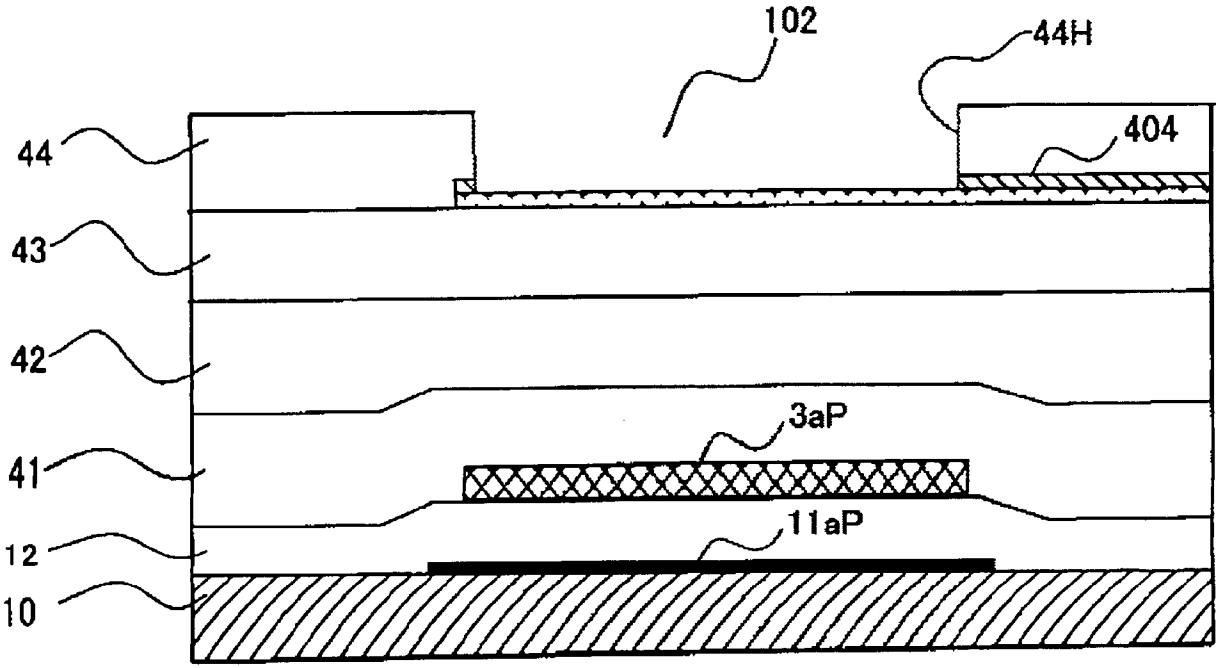
FIG. 7 is an enlarged schematic of a portion surrounded by a circle indicated by a capital "Z" in FIG. 2 and is a cross-sectional schematic corresponding to a laminate structure shown in FIG. 6.

FIG. 6 is a cross-sectional schematic taken along the plane A-A' when the views shown FIGS. 4 and 5 are overlapped with each other, FIG. 7 is an enlarged schematic of a portion surrounded by a circle indicated by a capital "Z" shown in FIG. 2 and is a cross-sectional view corresponding to a laminate structure shown in FIG. 6. In addition, in FIGS. 6 and 7, in order to easily recognize individual layers and constituent elements in the figure, the reduction scales thereof are allowed to differ from each other.

Circuit Structure of Pixel Portion

As shown in FIG. 3, in each of the plurality of pixels which are arranged in a matrix and form the image display region of the electro-optical device of this exemplary embodiment, a pixel electrode 9*a* and a TFT 30 used for pixel electrode 9*a* switching control are formed, and a data line 6*a* to which an image signal is supplied is electrically connected to the source of the TFT 30. Image signals S1, S2, . . . , and Sn to be written in the data lines 6*a* may be supplied in that order in a line sequential manner or may be supplied to each group formed of the data lines 6*a* adjacent to each other.

The gate electrode 3*a* is electrically connected to the gate of the TFT 30, and scanning signals G1, G2, . . . , and Gm in the form of pulse are applied at predetermined intervals to scanning lines 11*a* and the gate electrodes 3*a* in that order in a line sequential manner. The pixel electrode 9*a* is electrically connected to the drain of the TFT 30, and when the TFT 30 functioning as a switching element is closed for a predetermined period of time, the image signals S1, S2, . . . , and Sn supplied from the data lines 6*a* are written in the pixels at predetermined intervals.

The image signals S1, S2, . . . , Sn at predetermined levels written into the liquid crystal, which is one example of an electro-optical material, via the pixel electrodes 9*a*, are retained with the counter electrode formed on the counter substrate for a predetermined period of time. Since the alignment or the ordering of the molecular aggregate of the liquid crystal is changed in response to a voltage level applied thereto, light is modulated thereby, and as a result, gray scale display can be performed. In a normally white mode, the transmittance of incident light is decreased in response to a voltage applied to each pixel, and in a normally black mode, the transmittance of incident light is increased in response to a voltage applied to each pixel. Hence, on the whole, light having a contrast in accordance with the image signal is emitted from the electro-optical device.

In order to reduce or prevent the image signals thus retained from leaking, storage capacitors 70 are additionally formed in parallel to liquid crystal capacitors formed between the pixel electrodes 9*a* and the counter electrode. The storage capacitors 70 are provided along the scanning lines 11*a* and have a pixel-potential capacitor electrode and a constant-potential capacitor electrode 300 fixed at a constant potential.

Particular Structure of Pixel Portion

Hereinafter, a particular structure of the electro-optical device will be described with reference to FIGS. 4 to 7, in which the circuit operation described above is realized by constituent elements, such as the data lines 6*a*, scanning lines 11*a*, gate electrodes 3*a*, and TFTs 30.

First, as shown in FIGS. 4 and 5, the pixel electrodes 9*a* (outlines are indicated by dotted lines) are provided in a matrix on the TFT array substrate 10. Along the lateral and longitudinal boundaries between the pixel electrodes 9*a*, the data lines 6*a* and the scanning lines 11*a* are provided. The data line 6*a* has a laminate structure containing an aluminum film as described below. The scanning line 11*a* is formed, for example, of a conductive polycrystal silicon film. The scanning line 11*a* is electrically connected to the gate electrode 3*a* facing a channel region 1*a*' indicated by upward lines in the figure in a semiconductor layer 1*a* via a contact hole 12*cv*, and the gate electrode 3*a* is formed as a part of the scanning line 11*a*. At each of the intersections between the scanning line 11*a* and the data lines 6*a*, a pixel switching TFT 30 is provided in which the gate electrode 3*a* included in the scanning line 11*a* is disposed so as to face the channel region 1*a*'. Accordingly, the TFT 30 (except for the gate electrode) is placed between the gate electrode 3*a* and the scanning line 11*a*.

Next, as shown in FIG. 6, that is, the cross-sectional schematic taken along the plane A-A in FIGS. 4 and 5, the electro-optical device is composed of the TFT array substrate 10 made, for example, of a quartz substrate, a glass substrate, or a silicon substrate. The counter substrate 20 which faces thereto and is made, for example, of a glass substrate or a quartz substrate.

At the TFT array substrate 10 side, as shown in FIG. 6, the aforementioned pixel electrode 9*a* is provided, and at the upper side thereof, an alignment film 16 processed by predetermined orientation treatment, such as rubbing treatment is provided. The pixel electrode 9*a* is formed of a transparent conductive film, such as an ITO film. In addition, at the counter substrate 20 side, a counter electrode 21 is provided over the entire surface thereof. At the lower side thereof, an alignment film 22 processed by predetermined orientation treatment, such as rubbing treatment is provided. As is the pixel electrode 9*a* described above, the counter electrode 21 is formed of a transparent conductive film, such as an ITO film.

Between the TFT array substrate 10 and the counter substrate 20 facing thereto, an electro-optical material, such as liquid crystal is sealed in a space surrounded by the seal material 52 (see FIGS. 1 and 2), thereby forming the liquid crystal layer 50. The liquid crystal layer 50 is placed in a predetermined alignment state by the presence of the alignment films 16 and 22 when an electric field is not applied from the pixel electrode 9*a*.

In addition, on the TFT array substrate 10, besides the pixel electrode 9*a* and the alignment film 16 described above, various constituent elements are collectively assembled to form a laminate structure. As shown in FIG. 6, the laminate structure described above is composed of a first layer including the scanning line 11*a*, a second layer including, for example, the TFT 30 having the gate electrode 3*a*, a third layer including the storage capacitor 70, a fourth layer including, for example, the data line 6*a*, a fifth layer including, for example, a capacitor wire 400, which is an example of "capacitor wire" in the present invention, and a sixth layer (topmost layer) including the pixel electrode 9*a*, the alignment film 16, and the like, those layers described above being provided in that order from the bottom. In addition, an underlying insulating film 12, a first interlayer insulating film 41, a second interlayer insulating film 42, a third interlayer insulating film 43, a fourth interlayer insulating film 44 are provided between the first and the second layers, the second and the third layers, the third and the fourth layers, the fourth and the fifth layers, and the fifth and the sixth layers, respectively, so that short circuiting between the elements described above is reduced or prevented. In addition, in those various insulating films 12, 41, 42, 43, and 44, contact holes and the like are provided to electrically connect, for example, between the data line 6*a* and a highly doped region 1*d* in the semiconductor layer 1*a* of the TFT 30. Hereinafter, the individual elements will be described in accordance with the order from the bottom. The aforementioned first to third layers are collectively shown in FIG. 4 as the lower layer portion. The aforementioned fourth to sixth layers are collectively shown in FIG. 5 as the upper layer portion.

Laminate Structure, Structure of First Layer—Scanning Line Etc.

As the first layer, the scanning line 11*a* is provided which is formed, for example, of a pure metal, an alloy, a metal silicide, a polysilicide, or a laminate thereof, containing at least one high melting point metal selected from the group including Ti, Cr, W, Ta, Mo, and the like, or which is formed of conductive polysilicon. When viewed in plan, the scanning lines 11*a* are formed in a stripe pattern along the X direction in FIG. 4. Specifically, the scanning lines 11*a* in a stripe pattern are each formed of a primary line portion extending along the X direction shown in FIG. 4 and a protruding portion protruding along the Y direction in FIG. 4 in which the data line 6*a* or the capacitor wire 400 extends. The protruding portion of the scanning line 11*a* protruding from the primary line portion is not brought into contact with that of the adjacent scanning line 11*a*, that is, the scanning lines 11*a* are formed so as to be independently separated from each other.

Laminate Structure, Structure of Second Layer—TFT Etc.

Next, as the second layer, the TFT 30 containing the gate electrode 3*a* is provided. The TFT 30 has an LDD (Lightly Doped Drain) structure as shown in FIG. 6, and as the constituent elements thereof, there are provided the gate electrode 3*a* described above; the channel region 1*a*' of the semiconductor layer 1*a*, made of polysilicon or the like, in which a channel is formed by an electric field applied from the gate electrode 3*a*; an insulating film 2 which includes a gate insulating film insulating the gate electrode 3*a* from the semiconductor layer 1*a*; and lightly doped source region 1*b* and drain region 1*c*, and highly doped source region 1*d* and drain region 1*e*, which are provided in the semiconductor layer 1*a*.

In addition, in a first exemplary embodiment, as this second layer, a relay electrode 719 is formed as the same film as that for the gate electrode 3*a* described above. When viewed in plan, as shown in FIG. 4, this relay electrode 719 has an island shape and is located approximately at the center of one side of the pixel electrode 9*a* extending in the X direction. Since the relay electrode 719 is formed as the same film as that for the gate electrode 3*a*, when the latter is made of a conductive polysilicon film or the like, the former is also made of a conductive polysilicon film or the like.

Laminate Structure, Structure Between First Layer and Second Layer—Underlying Insulating Layer As shown in FIG. 6, on the scanning line 11*a* described above and under the TFT 30, the underlying insulating film 12 is provided which is made, for example, of a silicon oxide film. Since being formed over the entire surface of the TFT array substrate 10, besides a function of performing interlayer insulation between the scanning line 11*a* and the TFT 30, the underlying insulating film 12 also serves to reduce or prevent the properties of the pixel switching TFT 30 from being degraded. The degradation thereof may be caused, for example, by roughed surfaces of the TFT array substrate 10 by surface polishing or stains remaining after washing.

In this underlying insulating film 12, contact holes 12*cv* in the form of a groove are provided at two sides of the semiconductor layer 1*a* along the channel length thereof, the semiconductor layer 1*a* extending along the data line 6*a* which will be described later, and the gate electrode 3*a* has two concave portions at the two sides, which is provided on the semiconductor layer so as to correspond to the contact holes 12*cv*. Since formed so as to fill the entire contact holes 12*cv*, the gate electrode 3*a* has sidewall portions 3*b* integrally formed therewith. Accordingly, as shown in FIG. 4 in detail, the two sides of the semiconductor layer 1*a* of the TFT 30 are covered with the sidewall portions 3*b* when viewed in plan. Hence light incident on these portions at least is suppressed.

As shown in FIG. 4, this sidewall portion 3*b* is formed so as to fill the contact hole 12*cv* and is also brought into contact with the scanning line 11*a* at the bottom end. Since the scanning lines 11*a* are formed in a stripe pattern as described above, the gate electrodes 3*a* and the scanning line 11*a* present on the same row always have the same potential.

Laminate Structure, Structure of Third Layer—Storage Capacitor Etc.

Next, as shown in FIG. 6, as the third layer provided above the second layer described above, the storage capacitor 70 is provided. The storage capacitor 70 is formed of a lower electrode 71 and a capacitor electrode 300 with a dielectric film 75 provided therebetween. The lower electrode 71 functions as a pixel-potential capacitor electrode and is connected to the highly doped drain region 1*e* of the TFT 30 and the pixel electrode 9*a*. The capacitor electrode 300 functions as a fixed-potential capacitor electrode. By this storage capacitor 70, the potential-retaining properties of the pixel electrode 9*a* can be significantly enhanced. As can be seen from the schematic shown in FIG. 4, since the storage capacitor 70 according to the first exemplary embodiment is formed so as not to overlap a light transmitting region which approximately corresponds to a region of the pixel electrode 9*a* (the storage capacitor 70 is formed so as to be within a shading region), the pixel aperture ratio of the entire electro-optical device can be maintained at a relatively high level. Hence a brighter image can be displayed.

Specifically, the lower electrode 71 is composed, for example, of a conductive polysilicon film and serves as a pixel-potential capacitor electrode. However, the lower electrode 71 may also be formed of a single-layer film or a multilayer film containing a metal or an alloy. The lower electrode 71 has a function as a trunk connection between the pixel electrode 9*a* and the highly doped drain region 1*e* besides the function as the pixel-potential capacitor electrode. In this exemplary embodiment, this trunk connection is performed using the relay electrode 719 described above.

The capacitor electrode 300 functions as a fixed-potential capacitor electrode of the storage capacitor 70. In the first exemplary embodiment, in order to enable the capacitor electrode 300 to have a fixed potential, electrical connection is made with a capacitor wire 400 (described later) having a fixed potential. In addition, the capacitor electrode 300 is formed, for example, of a pure metal, an alloy, a metal silicide, a polysilicide, or a laminate thereof, containing at least one high melting point metal selected from the group including Ti, Cr, W, Ta, Mo, and the like, or may be formed of tungsten silicide. Accordingly, the capacitor electrode 300 has a function of shading light incident on the TFT 30 from above.

As shown in FIG. 6, the dielectric film 75 is formed, for example, of a silicon oxide film, such as an HTO (high temperature oxide) film or an LTO (low temperature oxide) film, or a silicon nitride film, having a relatively small thickness of approximately 5 to 200 mm. In order to increase the capacitance of the storage capacitor 70, as long as the reliability thereof can be ensured, the thickness of the dielectric film 75 is preferably decreased.

In the first exemplary embodiment, as shown in FIG. 6, this dielectric film 75 has a two-layered structure composed of a silicon oxide film 75*a* as a lower layer and a silicon nitride film 75*b* as an upper layer. The silicon nitride film 75*b* used as the upper layer is patterned so as to be slightly larger than the lower electrode 71 used as the pixel-potential capacitor electrode and is formed to be within the shading region (non-opening region).

Laminate Structure, Structure Between Second Layer and Third Layer—First Interlayer Insulating Film In the TFT 30 or the gate electrode 3*a*, and the relay electrode 719 described above, and under the storage capacitor 70, the first interlayer insulating film 41 is provided which is formed, for example, of a silicate glass film, such as NSG (non-silicate glass), PSG (phosphosilicate glass), BSG (borosilicate glass), or BPSG (borophosphosilicate glass), a silicon nitride film, or a silicon oxide film, or which may be formed of NSG.

Next, in this first interlayer insulating film 41, a contact hole 81 is formed which electrically connects between the data line 6*a* described later and the highly doped source region 1*d* of the TFT 30 while penetrating through the second interlayer insulating film 42 described later. In addition, in the first interlayer insulating film 41, a contact hole 83 is formed which electrically connects between the highly doped drain region 1*e* of the TFT 30 and the lower electrode 71 of the storage capacitor 70. Furthermore, in this first interlayer insulating film 41, a contact hole 881 is formed which electrically connects between the lower electrode 71 as the pixel-potential capacitor electrode of the storage capacitor 70 and the relay electrode 719. In the first interlayer insulating film 41, a contact hole 882 is formed which electrically connects between the relay electrode 719 and a second relay electrode 6*a*2 described later while penetrating the second interlayer insulating film described later.

Laminate Structure, Structure of Fourth Layer—Data Line Etc.

Next, as the fourth layer provided above the third layer described above, the data line 6*a* is provided. As shown in FIG. 6, this data line 6*a* is a film having a three-layered structure composed of an aluminum-based layer (see reference numeral 41A in FIG. 6), a titanium nitride-based layer (see reference numeral 41TN in FIG. 6), and a silicon nitride layer (see reference numeral 401 in FIG. 6). The silicon nitride film is formed by patterning slightly larger so as to cover the aluminum-based layer and the titanium nitride-based layer provided thereunder.

As this fourth layer, a capacitor wire relay layer 6*a*1 and the second relay electrode 6*a*2 are formed as the same film as that for the data line 6*a*. As shown in FIG. 5, when viewed in plan, those mentioned above are not formed to be in contact with the data line 6*a* and are formed separately from each other by patterning. For example, with respect to the data line 6*a* located at the most left side in FIG. 5, the capacitor wire relay layer 6*a*1 having an approximately rectangular shape is provided just at the right side. At the right side thereof, the second relay electrode 6*a*2 having an approximately rectangular shape slightly larger than the capacitor wire relay layer 6*a*1 is provided.

Laminate Structure, Structure Between Third Layer and Fourth Layer—Second Interlayer Insulating Film On the storage capacitor 70 described above and under the data line 6*a*, the second interlayer insulating film 42 is formed of a silicate glass, such as NSG, PSG, BSG, or BPSG, a silicon nitride film, or a silicon oxide film, or may be formed by a plasma CVD method using a TEOS gas. In this second interlayer insulating film 42, the contact hole 81 described above is formed to electrically connect between the highly doped source region 1*d* of the TFT 30 and the data line 6*a*, and a contact hole 801 is formed which electrically connects between the capacitor wire relay layer 6*a*1 and the capacitor electrode 300 used as the upper electrode of the storage capacitor 70. In addition, in the second interlayer insulating film 42, the contact hole 882 described above is formed which electrically connects between the second relay electrode 6*a*2 and the relay electrode 719.

Laminate Structure, Structure of Fifth Layer—Capacitor Wire Etc.

Next, as the fifth layer provided above the fourth layer described above, the capacitor wire 400 is formed. When viewed in plan, the capacitor wire 400 has a lattice pattern extending in the X direction and the Y direction in the figure, as shown in FIG. 5. In particular, part of the capacitor wire 400 extending in the Y direction has a larger width than that of the data line 6*a* so as to cover it. In addition, part of the capacitor wire 400 extending in the X direction has a notch portion in the vicinity of the center of one side of the pixel electrode 9*a* in order to ensure a region to form a third relay electrode 402 which will be described later.

Furthermore, as shown in FIG. 5, each intersection formed between the X direction and the Y direction portions of the capacitor wire 400 has an octagonal shape as if approximately triangle-shaped parts are placed at four corners of the intersection. Due to the presence of the approximately triangle-shaped parts described above, shading of light incident on the semiconductor layer 1*a* of the TFT 30 can be effectively performed. That is, light obliquely incident on the semiconductor layer 1*a* from above is to be reflected or absorbed by the triangle-shaped parts and cannot reach the semiconductor layer 1*a*. Hence, the generation of light leak current can be suppressed, and high quality image with no flicker can be displayed.

Since extending from the image display region 10*a* in which the pixel electrodes 9*a* are disposed to the periphery thereof and being electrically connected to a constant electrical source, this capacitor wire 400 has a fixed potential (refer to the description of an extending capacitor wire 404 described later).

As described above, due to the presence of the capacitor wire 400 formed so as to cover the entire data lines 6*a* and to have a fixed potential, the influence of capacitance coupling generated between the data line 6*a* and the pixel electrode 9*a* can be eliminated. Specifically, the case in which the potential of the pixel electrode 9*a* is varied in response to the electricity applied to the data line 6*a* can be reduced or prevented. The probability of generation of display irregularities or the like on an image along the data lines 6*a* can be decreased. Particularly in this exemplary embodiment, since the capacitor wire 400 is formed in a lattice pattern, the generation of unnecessary capacitance coupling can also be suppressed at places at which the scanning lines 11*a* extend.

As the fifth layer, the third relay electrode 402 is also formed as the same film as that for the capacitor wire 400 described above. This third relay electrode 402 has a function of electrically connecting between the second relay electrode 6*a*2 and the pixel electrode 9*a* via contact holes 804 and 89 described below. In this case, the capacitor wire 400 and the third relay electrode 402 are not formed to be in contact with each other and are formed separately from each other by patterning.

The capacitor wire 400 and the third relay electrode 402 each have a two-layered structure formed of an aluminum-based layer as a lower layer and a titanium nitride-based layer as an upper layer. Since containing aluminum having relatively superior light reflection properties and titanium nitride having relatively superior light absorption properties, the capacitor wire 400 and the third relay layer 402 are able to function as a shading layer. According to the structure described above, light incident (see FIG. 6) on the semiconductor layer 1*a* of the TFT 30 can be blocked at the side above the semiconductor layer 1*a*.

In this exemplary embodiment, in particular, the capacitor wire 400 is formed to extend in the peripheral region as shown in FIG. 7 (hereinafter, the capacitor wire in the peripheral region is called "extending capacitor wire 404" in order to discriminate it from the capacitor wire 400 provided in the image display region 10*a*). The extending capacitor wire 404 is formed as the same film as that for the capacitor wire 400 and the third relay electrode 402 (hereinafter "capacitor wire 400 and the like") on the third interlayer insulating film 43. Accordingly, as are the capacitor wire 400 and the third relay electrode 402, the extending capacitor wire 404 has a two-layered structure of an aluminum-based layer as a lower layer and a titanium nitride-based layer as an upper layer.

A part of this extending capacitor wire 404 forms the exterior circuit connection terminal 102 described above with reference to FIGS. 1 and 2. In particular, when a contact hole 44H communicating with the extending capacitor wire 404 is formed in the fourth interlayer insulating film 44 formed thereon, the upper surface of the extending capacitor wire 404 is exposed to the outside, thereby forming the exterior circuit connection terminal 102. As can be seen from the figure, the part of this extending capacitor wire 404 corresponds to the "electrode forming the exterior circuit connection terminal" in an aspect of the present invention.

The extending capacitor wires 404 as shown in FIG. 7 are formed in the same manner for all the exterior circuit connection terminals 102. However, among those described above, the number of extending capacitor wires 404 extending from the capacitor wire 400, specifically, the number of extending capacitor wires 404 electrically connected to the capacitor wire 400 is limited. As shown in FIG. 1, extending capacitor wires 404 corresponding to specific exterior circuit connection terminals 102 are only formed to extend from the capacitor wire 400, and although being formed as the same film as that for the capacitor wire 400, extending capacitor wires 404 corresponding to the remaining exterior circuit connection terminals 102 are formed separately from the capacitor wire 400 by patterning. In this exemplary embodiment, the specific exterior circuit connection terminals 102 (exterior circuit connection terminals 102 to which a predetermined potential is to be applied since being electrically connected to the extending capacitor wires 404, the predetermined potential being a potential to be applied to the capacitor electrode 300) may be at least one of the exterior circuit connection terminals 102 shown in FIG. 1. Specifically, among the exterior circuit connection terminals 102 described above, two specific exterior circuit connection terminals 102 may be formed at symmetrical positions with respect to the center line (not shown) running from the top to the bottom in the figure, or at least one exterior circuit connection terminal 102 may only be provided at one of the right and left sides with respect to the center line described above.

In this exemplary embodiment, the specific exterior circuit connection terminals 102 are connected to the scanning line drive circuit 104 and are also supplied with a constant potential at the lower potential side which is supplied to the scanning line drive circuit 104. Hence, the same potential as the constant potential is supplied to the capacitor wire 400. As a result, the same potential as the constant potential is supplied to the capacitor electrode 300 (see FIG. 6) electrically connected to the capacitor wire 400 via the contact holes 801 and 803 and the capacitive wire relay layer 6*a*1. However, as the "constant potential" to be supplied to the capacitor electrode 300, instead of the structure described above, a constant potential supplied to the data line drive circuit 101 may be used, or a constant potential supplied to the counter electrode 21 of the counter substrate 20 may also be used. The structures described above can easily be realized, for example, when the extending capacitor wire 404 to extend to the capacitor wire 400 is formed differently from that described above. In this case, for example, in particular, the above "formed differently from" is performed by appropriately changing a particular way of patterning (a patterning shape or the like) on the third interlayer insulating film 43, or in addition to or instead of the above, by appropriately changing the order of electrical power sources to be connected to the exterior circuit connection terminals 102.

As shown in FIG. 7, a step-adjusting film 11*a*P is formed as the same film as that for the scanning line 11*a* formed in the image display region. In addition, a step-adjusting film 3*a*P is formed as the same film as that for the gate electrode 3*a* and the relay electrode 719. Due to the presence of the step-adjusting films 11*a*P and 3*a*P, for example, the heights of the entire laminate structures of the image display region and the peripheral region can be adjusted approximately equivalent to each other. For example, the height of the capacitor wire 400 in the image display region can also be adjusted to be approximately equivalent to that of the exterior circuit connection terminal 102. Accordingly, for example, when a surface of the TFT array substrate is coated with an alignment film, followed by orientation by rubbing, the orientation treatment can be approximately uniformly performed over the surface of the TFT array substrate 10. In particular, the step-adjusting films 11*a*P and 3*a*P are not limited to form as the same film for the scanning line, the gate electrode, and the relay electrode and may be formed from any film as long as it is formed by patterning.

Laminate Structure, Structure Between Fourth Layer and Fifth Layer—Third Interlayer Insulating Film As shown in FIG. 6, on the data line 6*a* and under the capacitor wire 400, the third interlayer insulating film 43 is formed from a silicate glass, such as NSG, PSG, BSG, or BPSG, a silicon nitride film, or a silicon oxide film, or may be formed by a plasma CVD method using a TEOS gas. In this third interlayer insulating film 43, there are provided the contact hole 803 to electrically connect between the capacitor wire 400 and the capacitor wire relay layer 6a1 and the contact hole 804 to electrically connect between the third relay electrode 402 and the second relay electrode 6a2.

Laminate Structure, Structure of Sixth Layer and Structure Between Fifth Layer and Sixth Layer—Pixel Electrode etc.

Finally, as the sixth layer, the pixel electrodes 9a are formed in a matrix and the alignment film 16 is formed thereon. Under the pixel electrodes 9a, the fourth interlayer insulating film 44 is formed from a silicate glass, such as NSG, PSG, BSG, or BPSG, a silicon nitride film, or a silicon oxide film, or may be formed from NSG. In this fourth interlayer insulating film 44, the contact hole 89 to electrically connect between the pixel electrode 9a and the third relay electrode 402 is formed. The pixel electrode 9a and the TFT 30 are electrically connected to each other via the contact hole 89, the third relay layer 402, the contact hole 804, the second relay layer 6a2, the contact hole 882, the relay electrode 719, the contact hole 881, the lower electrode 71, and the contact hole 83.

In addition, in this exemplary embodiment, the surface of the fourth interlayer insulating film 44 is planarized by CMP (chemical mechanical polishing) treatment or the like. Hence, orientation defects of the liquid crystal layer 50 can be suppressed which are caused by the presence of steps formed by various wires and elements provided under the fourth interlayer insulating film 44. However, instead of the planarizing treatment for the fourth interlayer insulating film 44 or in addition thereto, planarizing treatment may be performed by filling the TFTs 30, the wires such as the data lines 6a, and the like into grooves formed in at least one of the TFT array substrate 10, the underlying insulating film 12, the first interlayer insulating film 41, the second interlayer insulating film 42, and the third interlayer insulating film 43.

Effects and Advantages of Electro-Optical Device

According to the electro-optical device of this exemplary embodiment having the above-described structure, particularly, due to the presence of the extending capacitor wire 404 described as the structure of the fifth layer, the following effects and advantages can be obtained.

First, in the exemplary embodiment described above, since the capacitor wire 400 and the extending capacitor wire 404 are formed as the same film on the third interlayer insulating film, as can be apparently seen from FIGS. 6 and 7, contact holes and the like for electrical connection therebetween are not required at all. Hence, the generation of inconveniences of an image, such as a horizontal cross-talk caused by contact holes having irregular properties, can be suppressed as much as possible.

Figure 8:
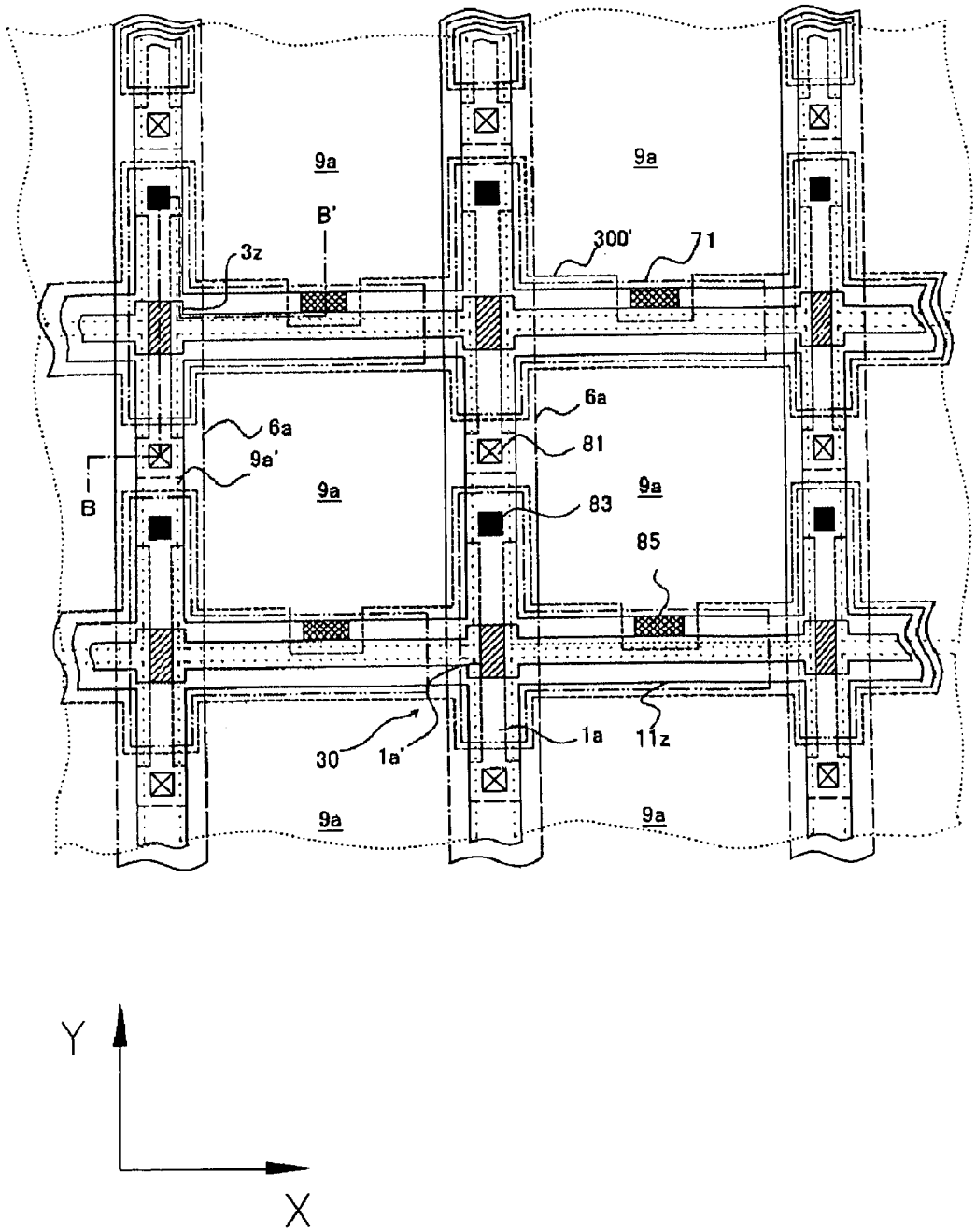
FIG. 8 is a schematic of a plurality of adjacent pixel groups on a TFT array substrate on which data lines, scanning lines, pixel electrodes, and the like are formed, the view corresponding to the views shown in FIGS. 4 and 5.
Figure 9:
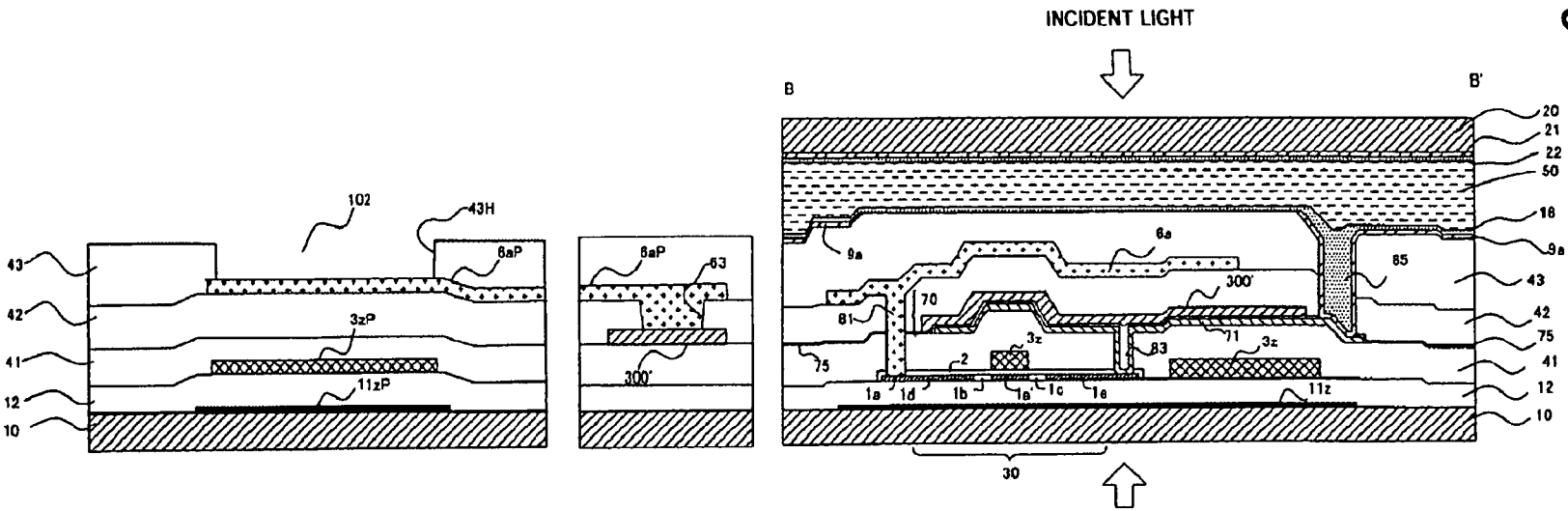
FIG. 9 includes a cross-sectional schematic taken along the plane B-B' in FIG. 8 and cross-sectional schematic of a laminate structure in the peripheral region.

The effects and advantages of the electro-optical device according to the exemplary embodiment will be apparent as compared to the structure shown in FIGS. 8 and 9 as a comparative example. FIG. 8 corresponds to FIGS. 4 and 5 and is a schematic of a plurality of adjacent pixel groups formed on a TFT array substrate on which data lines, scanning lines, pixel electrodes, and the like of an electro-optical device according to the comparative example are formed. FIG. 9 includes a cross-sectional schematic taken along the plane B-B' shown in FIG. 8 and cross-sectional schematics of a laminate structure in the peripheral region. In those figures, in order to indicate individual constituent elements (such as data lines, scanning lines, TFTs, storage capacitors, and the like) in the figures, the same reference numerals in FIGS. 4 to 7 are also used in some cases, and the use of the same reference numerals described above means that the elements indicated by the same reference numeral have functions substantially equivalent to each other. For example, it means that a data line "6a" shown in FIGS. 8 and 9 is an element having the same function as that of the data line "6a" shown in FIGS. 4 to 7, that is, the element described above has a function of supplying an image signal to the pixel electrode 9a via the TFT 30 (as for the pixel electrode "9a" and TFT "30", based on the same understanding as described above, the same reference numerals are also used in those figures).

In FIGS. 8 and 9, as an element having the structure apparently different from that of shown in FIGS. 4 to 7, a capacitor line 300' may be mentioned. That is, in FIGS. 8 and 9, one of the electrodes forming the storage capacitor 70 is not formed to have an island shape (see FIG. 4) as that of the capacitor electrode 300 but is formed to have a strip shape extending in the X direction in the figure. However, as is the capacitor electrode 300, in order to obtain shading properties to shade light incident from the upper side of the TFT 30, this capacitor line 300' is formed of a shading material, such as tungsten silicide as is the case described above by way of example.

In addition, when the structure shown in FIGS. 8 and 9 is compared to that shown in FIGS. 4 to 7, the number of layers of the laminate structure is smaller by one layer (that is, the fourth interlayer insulating film 44 is the topmost interlayer insulating layer of the structure shown in FIGS. 4 to 7. But the third interlayer insulating film 43 is the topmost interlayer insulating layer of the structure shown in FIGS. 8 and 9). Accordingly, in FIGS. 8 and 9, in order to form the exterior circuit connection terminal 102, a wire 6aP formed as the same film as that for the data line 6a is provided in the peripheral region. The exterior circuit connection terminal 102 is formed of a part of the wire 6aP exposed to the outside through a contact hole 43H formed in the third interlayer insulating film 43.

Next, in the electro-optical device of the comparative example shown in FIGS. 8 and 9, as shown by a cross-sectional schematic at the center in FIG. 9, in order to allow the capacitor line 300' to have a constant potential, the capacitor line 300' and the wire 6aP are formed to be electrically connected to each other via a contact hole 63 in a region approximately corresponding to a region indicated by a capital "G" in FIG. 1. The contact holes 63 are formed for the respective capacitor lines 300' extending in the X direction in FIG. 8. The wires 6aP are formed to fill the contact holes 63 and to extend in the Y direction shown in FIG. 8, so that a constant potential is to be supplied to the capacitor lines 300'. In this case, although the wire 6aP is formed as the same film as that for the data line 6a, the former and the latter are formed to be apparently independent of each other by patterning (otherwise, the data line 6a cannot serve to supply an image signal.) In addition, the wire 6aP is not formed as the same film as that for the capacitor line 300'.

In the electro-optical device having the structure shown in FIGS. 8 and 9, due to the capacitor line 300' itself or the contact hole 63 electrically connecting between the capacitor line 300' and the wire 6aP, a horizontal cross-talk may occur in some cases. The reason for this is that it becomes difficult to stably supply a predetermined constant potential to each capacitor line 300' since, for example, the resistance may be increased with high probability due to the presence of the contact hole 63, and the variation in properties between the contact holes 63 may occur in some cases. The horizontal cross-talk caused by the capacitor line 300' itself may obviously occur when the capacitor line 300' is formed of a high electrical resistant material, such as tungsten silicide as mentioned above. In order to reduce the likelihood or prevent the problem described above, it may be considered that the capacitor line 300' is formed using a material having an appropriately low electrical resistance. However, in the case described above, the shading properties may not be sufficiently obtained. In addition, a high-temperature process may not be used to form the constituent elements on the capacitor line 300' in some cases.

Hence, according to this exemplary embodiment, the various problems described above can be reduced or prevented. As described above, the reason for this is that the extending capacitor wire 404 forming the exterior circuit connection terminal 102 and the capacitor wire 400 are formed as the same film and are electrically connected to each other in this exemplary embodiment. Accordingly, the increase in resistance caused by the presence of the contact hole may not occur at all. In addition, in this exemplary embodiment, the wires made of a high electrical resistant material, such as tungsten silicide are not formed in a stripe pattern in the image display region unlike the capacitor line 300', and the island-shaped capacitor electrodes 300 are only formed. Hence, even when the capacitor electrode 300 is formed of a high electrical resistant material, such as tungsten silicide, a horizontal cross-talk caused thereby may hardly occur.

In addition, although not directly relating to the effects and advantages of the electro-optical device according to this exemplary embodiment, a line corresponding to the scanning line 11*a* formed as the first layer, shown in FIGS. 4 to 7, is not formed in the structure shown in FIGS. 8 and 9. Instead of the scanning line 11*a*, a lower side shading film 11*z* is formed which only functions to shade light incident from the lower side of the TFT 30. Accordingly, unlike the scanning lines 11*a*, the lower side shading film 11*z* is not necessary to be divided into lines and is formed to have a lattice pattern as shown in FIG. 8. In addition, unlike the gate electrode 3*a* formed as the second layer, shown in FIGS. 4 to 7, the gate electrode, shown in FIGS. 8 and 9, is not a simple gate electrode and is formed as a scanning line 3*z* (that is, the gate electrode is formed as a part of the scanning line 3*z*).

Next, as the second effect and advantage of this exemplary embodiment, since the extending capacitor wire 404 and the capacitor wire 400 of this exemplary embodiment are formed on the data line 6*a* with the third interlayer insulating film 43 interposed therebetween, the extending capacitor wire 404 and the capacitor wire 400 can be easily formed as the same film. The requirement of exposing the exterior circuit connection terminal 102 to the outside can be easily achieved (see FIG. 7). In addition, particularly in this exemplary embodiment, since the extending capacitor wires 404 and the capacitor wire 400 are both formed immediately under the sixth layer containing the pixel electrodes 9*a*, specifically, are formed under the pixel electrodes 9*a* only with the fourth interlayer insulating film 44 interposed therebetween, the effect and advantage described above can be more effectively obtained. By the structure as described above, since the contact hole 44H to form the exterior circuit connection terminal 102 may be provided only in the fourth interlayer insulating film 44 as shown in FIG. 7, the depth of the contact hole 44H is relatively small, and the formation thereof becomes relatively easy.

In addition to the structure described above, in this exemplary embodiment, the capacitor electrode 300 is formed below the data line 6*a* with the second interlayer insulating film 42 interposed therebetween. The laminate structure including the capacitor wire 400 and the storage capacitor 70 can be formed. That is, in the structure in which the capacitor electrode 300 is formed below the data line 6*a*, the capacitor electrode 300 can be formed in a region right under the data line 6*a*. In this exemplary embodiment, the capacitor electrode 300 and the lower electrode 71 are actually formed so that the protruding portions thereof protruding in the Y direction are located under the data line 6*a* extending in the Y direction (see FIG. 4). According to this structure, the area of the storage capacitor 70 can be increased. Hence the increase in capacitance can be realized.

As described above, in this exemplary embodiment, since the laminate structure is formed of the capacitor electrode 300, the data line 6*a*, and the capacitor wire 400 in that order from the bottom, the various effects and advantages described above can be obtained.

Next, as the third effect and advantage of this exemplary embodiment, since at least one of the extending capacitor wires 404 is formed to extend to the capacitor wire 400, and the above at least one of the extending capacitor wires 404 is electrically connected to a specific exterior circuit connection terminal 102 (to this terminal 102, the potential at a lower potential side supplied to the scanning line drive circuit 104 is supplied as described above), a specific electrical power supply is not necessary which enables the capacitor wire 400, specifically, the capacitor electrode 300, to have a constant potential. Accordingly, the structure of the electro-optical device can be simplified.

Fourth, in this exemplary embodiment, since being formed as the same film for the capacitor wire 400 and the like, the extending capacitor wire 404 has a two-layered structure made of an alumina-based layer as a lower layer and a titanium nitride-based layer as an upper surface. From this structure, the extending capacitor wire 404 may obtain the same effect and advantage as that of the capacitor wire 400 and the like described above. Since containing aluminum having relatively superior light reflection properties and titanium nitride having relatively superior light absorption properties, the extending capacitor wire 404 may serve as a shading layer.

Since the extending capacitor wire 404 contains a layer formed of titanium nitride, the contact hole 44H can be relatively easily formed in the fourth interlayer insulating film 44 provided on the extending capacitor wire 404. The reason for this is that when the contact hole 44H is formed in the fourth interlayer insulating film 44 by dry etching or the like, a layer formed of titanium nitride serves as an etch stopper or as a barrier metal. The layer formed of titanium nitride can reduce or prevent so-called over-etching, and hence it is not necessary to pay a specific attention to detect the end point of the dry etching. However, the formation of the contact hole 44H may be performed so as to remove the titanium nitride used as the upper layer of the extending capacitor wire 404. Accordingly, when the extending capacitor wire 404 and an exterior circuit are electrically connected to each other, the exterior circuit can be directly connected to the film formed of aluminum used as the lower layer. Hence a lower electrical resistance at the connection face can be obtained.

Electronic Apparatus

Figure 10:
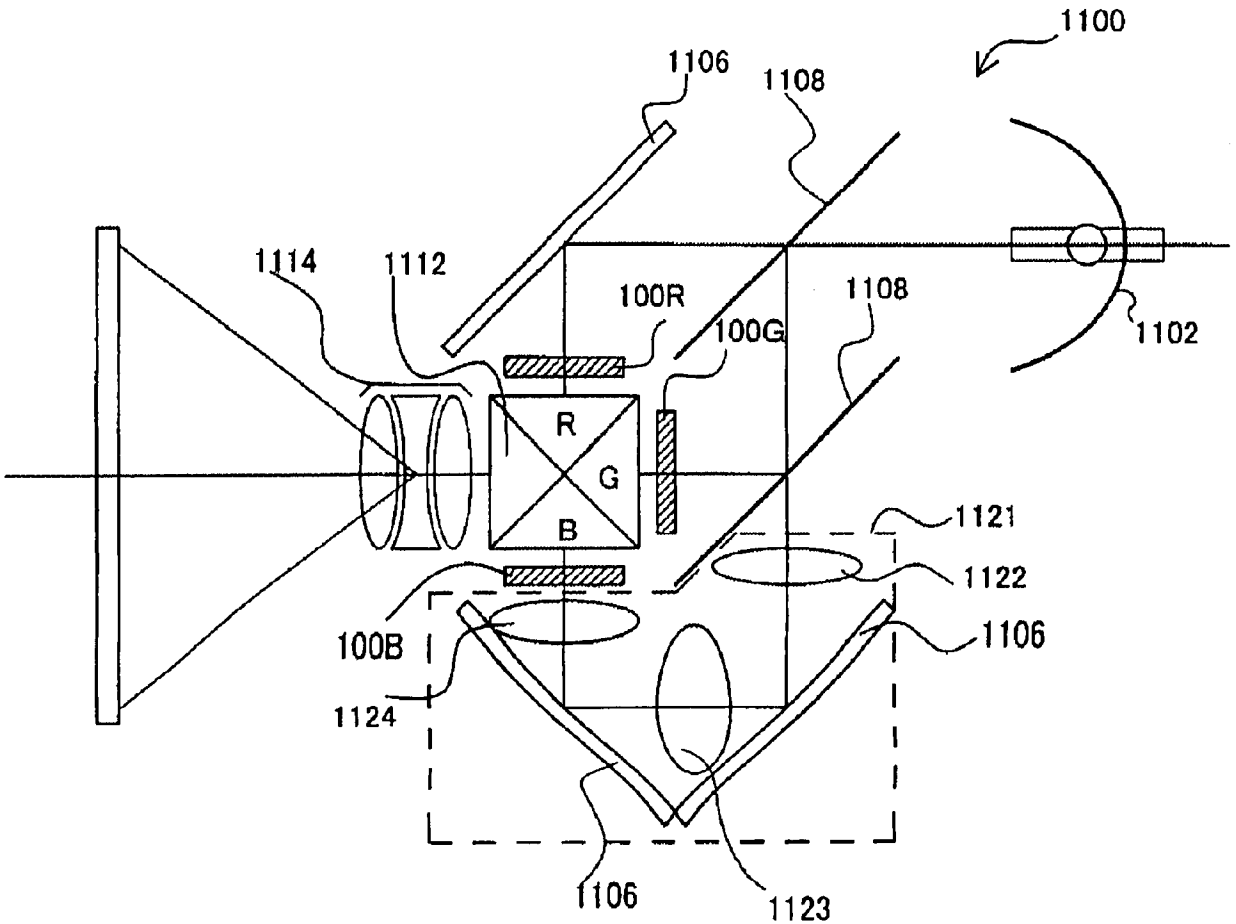
FIG. 10 is a schematic of a projection type liquid crystal device of an exemplary embodiment according to the present invention.

Next, as for an exemplary embodiment of a projection type color display device, which is one example of an electronic apparatus, using the electro-optical device described above in detail as a light valve, the entire structure, and in particular, an optical structure will be described. FIG. 10 is a cross-sectional schematic of a projection type color display device.

In FIG. 10, in a liquid crystal projector 1100 as one example of a projection type color display device according to this exemplary embodiment, three liquid crystal modules are used as RGB light valves 100R, 100G, and 100B to form a projector, the liquid crystal modules each containing the liquid crystal device in which a drive circuit is mounted on the TFT array substrate. In the liquid crystal projector 1100, when being emitted from a lamp unit 1102 of a white light source, such as a metal halide lamp, projection light is separated into light components R, G, and B corresponding to the three primary colors RGB by three mirrors 1106 and two dichroic mirrors 1108. The individual light components are supplied to the respective light valves 100R, 100G, and 100B. The blue (B) light is supplied through a relay lens system 1121 in order to reduce or prevent optical loss due to a long light path. The relay lens system is formed of an entrance lens 1122, a relay lens 1123, and an exit lens 1124. Subsequently, after the light components corresponding to the primary three colors are modulated by the light valves 100R, 100G, and 100B and are then again synthesized by a dichroic prism 1112, the light thus synthesized is projected as a color image on a screen 1120 via a projection lens 1114.

The present invention is not limited to the exemplary embodiments described above. It is to be understood that various changes and modification may be made without departing from the spirit and the scope of the present invention. In addition, it is to be understood that the changed and modified electro-optical devices and electronic apparatuses in accordance with the understanding described above are also included in the technical scope of the present invention.

What is claimed is:

1. An electro-optical device comprising:

a substrate;

data lines formed above the substrate and extending in a predetermined direction and scanning lines formed above the substrate and extending in a direction intersecting the data lines;

switching elements to which scanning signals are supplied from the scanning lines;

pixel electrodes to which image signals are supplied from the data lines via the switching elements;

a relay electrode that electrically connects one of the switching elements to one of the pixel electrodes;

an image display region defined as a region of the substrate in which the pixel electrodes and the switching elements are formed;

a peripheral region defining the periphery of the image display region;

a driver disposed in the peripheral region;

exterior circuit connection terminals comprising electrodes provided in the peripheral region at a position between the driver and a peripheral edge of the substrate;

storage capacitors comprising capacitor electrodes to retain potentials of the pixel electrodes for a predetermined period of time; and a capacitor wire which supplies voltage to the capacitor electrodes, wherein the capacitor wire, the electrodes of the exterior circuit connection terminals and the relay electrode are each formed of a same material and in the same film, and wherein the capacitor wire the electrodes of the exterior circuit connection terminals and the relay electrode each have a plural layered structure including an aluminum-based layer and a layer based on a metal other than aluminum.

2. The electro-optical device according to claim 1, the capacitor wire formed on the data lines with a first interlayer insulating film interposed therebetween.

3. The electro-optical device according to claim 1, the capacitor wire formed in a layer located immediately under a layer including the pixel electrodes.

4. The electro-optical device according to claim 1, the capacitor electrodes provided below the data lines with a second interlayer insulating film interposed therebetween.

5. The electro-optical device according to claim 1, further comprising:

a scanning line drive circuit, a potential supplied to the capacitor wire including a potential supplied to the scanning line drive circuit.

6. The electro-optical device according to claim 1, further comprising:

a counter substrate and a counter electrode provided above the counter substrate;

a potential supplied to the capacitor wire including a potential supplied to the counter electrode.

7. The electro-optical device according to claim 1, the capacitor wire including a shading material.

8. The electro-optical device according to claim 1, the capacitor wire having a multilayer structure including different materials.

9. The electro-optical device according to claim 1, the capacitor wire having a lattice pattern in the image display region when viewed in plan.

10. The electro-optical device according to claim 9, the capacitor wire formed in the lattice pattern having intersections each having at least one of approximately triangle shaped section at least one of four corners of the intersections.

11. The electro-optical device according to claim 1, further comprising:

a step-adjusting film under a region corresponding to the exterior circuit connection terminals, the step-adjusting film adjusting the height of the capacitor wire and that of the exterior circuit connection terminals to be approximately equivalent to each other with respect to the surface of the substrate.

12. An electronic apparatus, comprising:

the electro-optical device according to claim 1.

13. The electro-optical device according to claim 1, the capacitor wire, the electrodes of the exterior circuit connection terminals and the relay electrode each having a two-layered structure formed of an aluminum-based layer as a lower layer and a titanium nitride-based layer as an upper layer.

* * * * *

UNITED STATES PATENT AND TRADEMARK OFFICE

CERTIFICATE OF CORRECTION

PATENT NO. : 7,667,681 B2
APPLICATION NO. : 10/821932
DATED : February 23, 2010
INVENTOR(S) : Masao Murade It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 969 days.

Signed and Sealed this

Twenty-eighth Day of December, 2010

David J. Kappos

David J. Kappos
*Director of the United States Patent and Trademark Office*